US008020733B2

(12) United States Patent
Snodgrass

(10) Patent No.: US 8,020,733 B2
(45) Date of Patent: Sep. 20, 2011

(54) KEYED DISPENSING CARTRIDGE SYSTEM

(75) Inventor: David L. Snodgrass, Stuart, FL (US)

(73) Assignee: UltraClenz, LLC, Jupiter, FL (US)

( * ) Notice: Subject to any disclaimer, the term of this patent is extended or adjusted under 35 U.S.C. 154(b) by 376 days.

(21) Appl. No.: 11/803,949

(22) Filed: May 16, 2007

(65) Prior Publication Data

US 2008/0283556 A1 Nov. 20, 2008

(51) Int. Cl.
*B67D 5/06* (2006.01)

(52) U.S. Cl. ..... 222/325; 222/181.3

(58) Field of Classification Search ..... 222/325, 222/105, 181.3, 183, 153.03, 153.01, 153.02, 222/153.04, 153.09
See application file for complete search history.

(56) References Cited

U.S. PATENT DOCUMENTS 4,322,018 A * 3/1982 Rutter ..... 222/83
4,429,812 A 2/1984 Steiner et al.
4,894,874 A 1/1990 Wilson
4,911,331 A * 3/1990 Sedam ..... 222/132
4,948,014 A 8/1990 Rutter et al.
4,974,753 A * 12/1990 Tucker et al. ..... 222/181.2
5,025,516 A 6/1991 Wilson
5,100,030 A * 3/1992 Roggenburg et al. ..... 222/181.2
5,209,377 A 5/1993 Steiner et al.
5,240,147 A * 8/1993 Frazier et al. ..... 222/153.03
5,465,877 A * 11/1995 Bell et al. ..... 222/181.2
5,501,372 A * 3/1996 Daansen ..... 222/207
5,549,273 A 8/1996 Aharon
5,586,573 A 12/1996 Nortier
5,875,921 A * 3/1999 Osgar et al. ..... 222/1
5,944,227 A * 8/1999 Schroeder et al. ..... 222/144.5
5,992,698 A 11/1999 Copeland et al.
6,082,407 A 7/2000 Paterson et al.
6,125,482 A 10/2000 Foster
6,127,671 A 10/2000 Parsons et al.
6,131,773 A 10/2000 Wade et al.
6,209,184 B1 4/2001 Copeland et al.
6,294,786 B1 9/2001 Marcichow et al.
6,412,666 B1 * 7/2002 Hogan et al. ..... 222/325
6,420,737 B1 7/2002 Fan
6,435,372 B1 * 8/2002 Blacker et al. ..... 222/23
6,644,339 B2 * 11/2003 Gorges et al. ..... 137/315.41
6,758,372 B2 7/2004 Studer et al.

(Continued)

OTHER PUBLICATIONS

International Search Report and Written Opinion of the International Search Authority dated Sep. 4, 2008.

(Continued)

*Primary Examiner* — Kevin P Shaver
*Assistant Examiner* — Donnell Long
(74) *Attorney, Agent, or Firm* — Peter J. Phillips; Lucas & Mercanti, LLP

(57) ABSTRACT

A dispensing system for dispensing cleaning product for hand washing at a faucet comprises a cartridge having an internal reservoir for containing hand wash cleaning product, a nozzle configured in one of a plurality of key shapes, and a dispenser having a receptacle opening adapted to receive and engage the nozzle of the cartridge when the receptacle opening is configured in one of a plurality of key shapes corresponding to the key shape of the nozzle, the dispenser having a fluid communication passage for dispensing fluid for hand washing, whereby only cartridges and dispensers which have matched key shapes will engage each other for operative discharge of the hand wash cleaning product.

21 Claims, 5 Drawing Sheets

U.S. PATENT DOCUMENTS

| | | | | |
|---|---|---|---|---|
| 6,877,642 | B1 * | 4/2005 | Maddox et al. | 222/181.3 |
| 6,929,154 | B2 * | 8/2005 | Grey et al. | 222/153.03 |
| 7,028,861 | B2 | 4/2006 | Sayers et al. | |
| 7,104,519 | B2 | 9/2006 | O'Maley et al. | |
| 7,575,022 | B2 * | 8/2009 | Higgins | 137/558 |
| 2002/0092996 | A1 | 7/2002 | Fan | |
| 2007/0272709 | A9 * | 11/2007 | Ciavarella et al. | 222/181.3 |

OTHER PUBLICATIONS iTouchless—EZ Faucet Infrared Sensor Faucet Adaptor; Four page printout from www.itouchless.com on Mar. 21, 2007.

Optima and Optima Plus Gooseneck Faucets, Sloan Valve; Two page printout from www.sloanvalve.com on Mar. 21, 2007.

Sloan Optima Systems—Optima plus—Battery Powered Hand Washing Faucet—EBF—550 Optima Plus EBF-550 S.S.—Rev. 1b (09.05); Two page brochure.

Sloan Optima Electronic Faucets; Two page printout from www.sloanvalve.com on Mar. 21, 2007.

48-37 Water Sense Automatic Faucet Controller (Project 93-52); Two page printout from decs.nhgl.med.navy.mil/Dis48/sec25.htm on Mar. 21, 2007.

* cited by examiner

KEYED DISPENSING CARTRIDGE SYSTEM

BACKGROUND OF THE INVENTION

The present invention relates to dispensers designed to dispense a fluid chemical in either a liquid or foam form, and more particularly to keying liquid chemical cartridges to such dispensers. With increase awareness and regulations applying to hygiene especially in the food and healthcare industries, many hygiene systems have been proposed to improve hand compliance by workers. Many systems use a single product, such as a hand wash soap or detergent across all industries and customer applications. Many of the dispenser which dispense product may be refilled by maintenance personnel at the site of the system. The soap or detergent that is used to refill the dispenser may be not optimal or may even be inappropriate for the particular hygiene application, or may not work properly in the dispenser due to the chemical or viscosity characteristics of the product. The pump used to dispense the product may become inoperable due to clogging, which leads to the undesirable result of workers not using any product when hand washing, rendering the operation ineffective for proper hygiene.

SUMMARY OF THE INVENTION

The present invention relates to a cartridge for a hygiene product dispenser comprising a bottle to contain the product and a pump assembly that will dispense the product when activated. The product may be a liquid chemical in either liquid or foam form, and as used herein the term "liquid" includes a foam. As used herein the term "cleaning product" or "liquid chemical" also includes hand santizers. The container for containing the liquid chemical my be a bottle having a structured size and shape, or it may be a bag having flexible sides such as a bag-in-box configuration.

The present invention provides a dispensing system for dispensing fluid product, comprising a cartridge having an internal reservoir for containing fluid product, and a nozzle configured in one off a plurality of key shapes; and a dispenser having a receptacle opening adapted to receive and engage the nozzle of the cartridge when the receptacle opening is configured in one of a plurality of key shapes corresponding to the key shape of the nozzle, the dispenser having a fluid communication passage for dispensing fluid, whereby only cartridges and dispensers which have matched key shapes will engage each other for operative discharge of the fluid product.

The present invention provides a cartridge for use in a dispensing system for fluid product, comprising an internal reservoir for containing fluid product, and a nozzle configured in one of a plurality of key shapes, said nozzle adapted to be received by and engage a receptacle opening in a dispenser when the receptacle opening is configured in one of a plurality of key shapes corresponding to the key shape of the nozzle.

The invention provides a cartridge for use in a dispensing system for fluid product, comprising an internal reservoir for containing fluid product, and a nozzle having at least two radial raised fins having different configurations, said nozzle being adapted to be received by and engage a receptacle opening in a dispenser when the receptacle opening is configured to have radial slots corresponding in shape to the radial raised fins.

The present invention provides a way to make cartridges unique and proprietary to customers and users. The arrangement also provides a quality control function so that end users do not refill the cartridges with inferior cleaning chemicals, or replacement chemical dispensers from other suppliers.

Other advantages will become apparent from the drawings and detailed description of a preferred embodiment.

DETAILED DESCRIPTION OF A PREFERRED EMBODIMENT

Figure 1B:
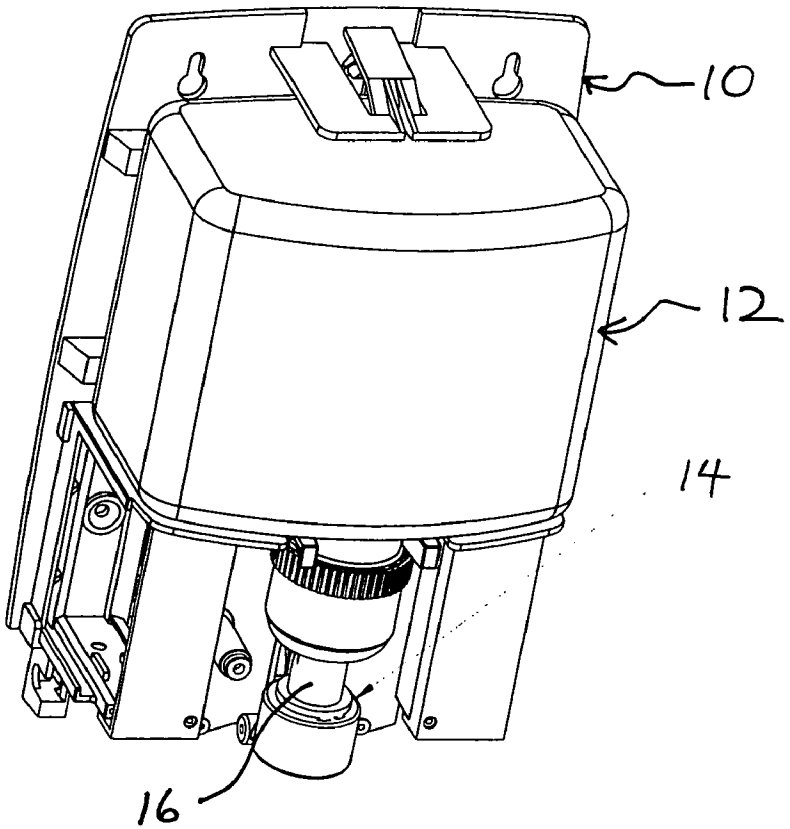
FIGS. 1A and 1B are perspectives view of a dispenser system without (FIG. 1A) and with (FIG. 1B) a bottle cartridge.

A preferred embodiment of the invention will be described, but the invention is not limited to this embodiment.

The present invention provides a dispensing system for dispensing cleaning product for hand washing at a faucet, comprising a cartridge having an internal reservoir for containing hand wash cleaning product, and a nozzle configured in one of a plurality of key shapes; and a dispenser having a block with a receptacle opening adapted to receive and engage the nozzle of the cartridge when the receptacle opening is configured in one of a plurality of key shapes corresponding to the key shape of the nozzle, the dispenser having a fluid communication passage for dispensing fluid for hand washing, whereby only cartridges and dispensers which have matched key shapes will engage each other for operative discharge of the hand wash cleaning product.

The cartridge may comprise a bottle, a flexible bag or a flexible bag in a box. The key shape of the cartridge may comprise at least one radial raised fin located on the exterior of the nozzle. The key shape of the dispenser may comprise at least one radial slot defined in the dispenser block. The key shape of the cartridge may comprise at least two radial raised fins, including at least one index key and one major key. The key shape of the cartridge may comprise at least three radial raised fins, including at least one index key, one major key and one minor key. The index key may extend further along a surface of the nozzle than any other keys, to engage a corresponding radial slot in the dispenser block before any other keys in the cartridge, to thereby align the cartridge rotationally with the dispenser block.

The present invention provides a cartridge for use in a dispensing system for handwashing at a faucet, comprising an internal reservoir for containing hand wash cleaning product, and a nozzle configured in one of a plurality of key shapes, said nozzle adapted to be received by and engage a receptacle opening in a dispenser when the receptacle opening is configured in one of a plurality of key shapes corresponding to the key shape of the nozzle.

The cartridge may comprise a bottle, a flexible bag or a flexible bag in a box. The key shape of the cartridge may comprise at least one radial raised fin located on the exterior of the nozzle. The key shape of the cartridge may comprise at least two radial raised fins, including at least one index key and one major key different in configuration from the index key. The key shape of the cartridge may comprise at least three radial raised fins, including at least one index key, one major key and one minor key, each of said keys being different in configuration from each other. The index key may extend further along a surface of the nozzle than any other keys, to engage a corresponding radial slot in the dispenser block before any other keys in the cartridge, to thereby align the cartridge rotationally with the dispenser block.

The invention provides a cartridge for use in a dispensing system for hand washing at a faucet, comprising an internal reservoir for containing hand wash cleaning product, and a nozzle having at least two radial raised fins having different configurations, said nozzle being adapted to be received by and engage a receptacle opening in a dispenser when the receptacle opening is configured to have radial slots corresponding in shape to the radial raised fins.

The cartridge may have at least three radial raised fins having different configurations.

Figure 1A:
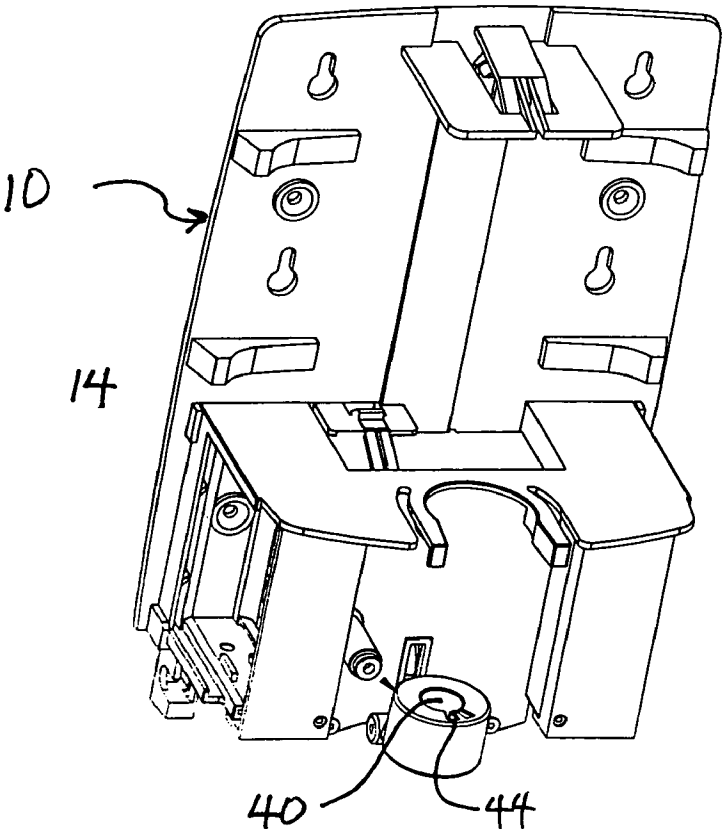

FIG. 1A shows a dispenser 10 without a cartridge, and FIG. 1B shows a dispenser 10 with a cartridge 12.

In FIG. 1A, a keyed swivel block 14 is adapted to accept and mate with a correspondingly keyed nozzle 16 of a cartridge 12.

Figure 2:
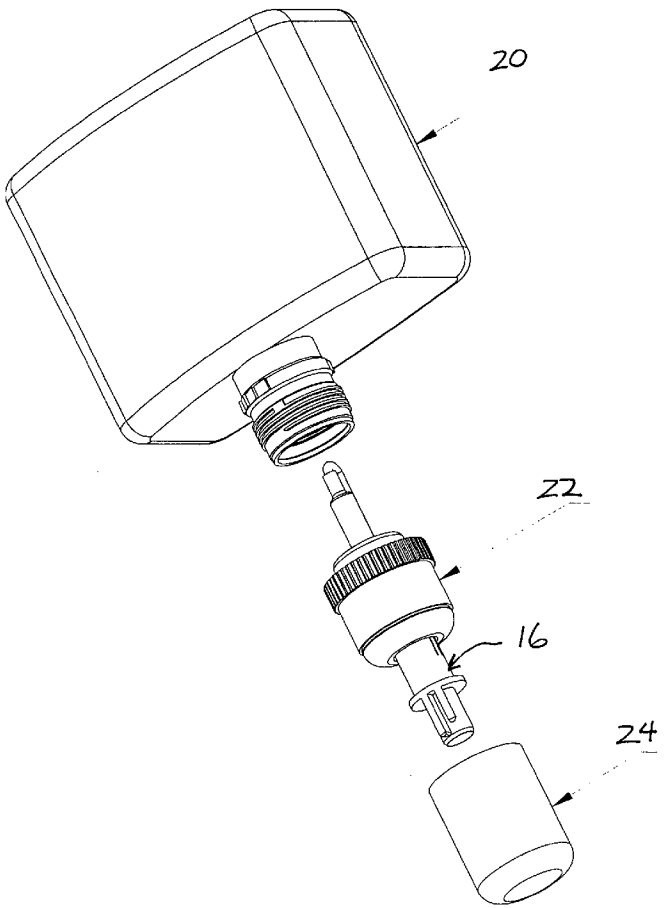
FIG. 2 is a perspective view of a bottle, pump assembly and overcap.

FIG. 2 shows the cartridge 12 in more detail. The cartridge 12 comprises a bottle 20 for holding dispensing agent such as liquid handsoap, a pump assembly 22 which may be threaded onto the bottle, and an overcap 24 which protects the nozzle 16 during transport and storage before it is mounted onto the dispenser.

The bottle 20 in the form of a closed reservoir. The reservoir can be vented or unvented. The bottle may be formed of 1.0 mm thick low density polyethylene (LDPE) or high density polyethylene (HDPE) allowing it to easily collapse when the liquid chemical content is evacuated and a vacuum is created.

The pump assembly 22 may include an Airspray® L11 (0.75 ml), L9 (1-20 ml), L7 (1.5 ml) or similar piston pump. The pump is designed to dispense a liquid in the form of foam but versions are available that do not create foam. Accordingly, the option of foam or non-foam may be made by the user or as dictated by the hygiene application.

The nozzle 16 provides an activation interface between the pump assembly 22 and dispenser 10. The nozzle 16 also serves to direct the stream of chemical being dispensed.

The pump assembly 22 may be attached to a plastic flexible bag to provide a bag-in-box style cartridge configuration. This bottle variation has a collar with a bottle neck with a 5.0 mm flange. The collar will attach to the pump assembly 22 in the same way as the bottle 20. The flange provides a surface that can be used to form an ultrasonic weld between the bag and the collar.

The preferred embodiment has a mechanical keying arrangement between the cartridge 12 and dispenser 10. The keying arrangement may be in the form of a key on one of the cartridge 12 and dispenser 10, and a key hole on the other. The key hole may be located on the part of the dispenser called the swivel block 14, as shown in FIG. 1. The swivel block 14 holds and lifts the pump nozzle 16. When the dispenser is activated (which may be by powered means powered by a battery), the swivel block 14 will rise pushing the nozzle 16 into the pump assembly causing the pump to dispense dispensing agent.

Figure 3:
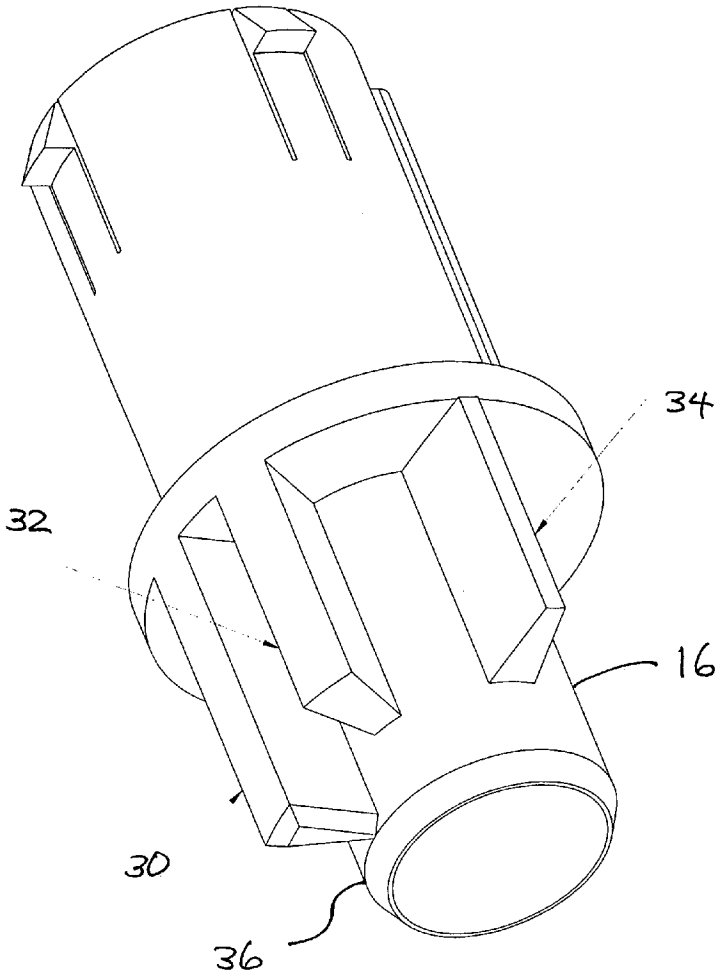
FIG. 3 is a perspective view of an embodiment of a cartridge nozzle having a key arrangement.

As shown in FIG. 3, the nozzle 16 has a tip 36 at one end through which dispensing agent exits, and at the other end a plurality of tangs which lock into a bottle or bag.

As shown in FIG. 3, the cartridge nozzle 16 has a key in the form of an index key 30, a major key 32 and a minor key 34. For the cartridge nozzle 16 to mate with the dispenser swivel block 14, the cartridge nozzle 16 should be aligned so that the index, major and minor keys are aligned with corresponding index, major and minor keyholes in the swivel block 14, while the central shaft of the nozzle 16 is aligned in the central opening 40 in the swivel block 14. The index, major and minor keys are in the form of radial fins 42, and the index, major and minor keyholes are in the form of radial slots 44 radiating the central opening 40 in the swivel block. Only two slots 44 are shown in FIG. 1A.

Figure 4:
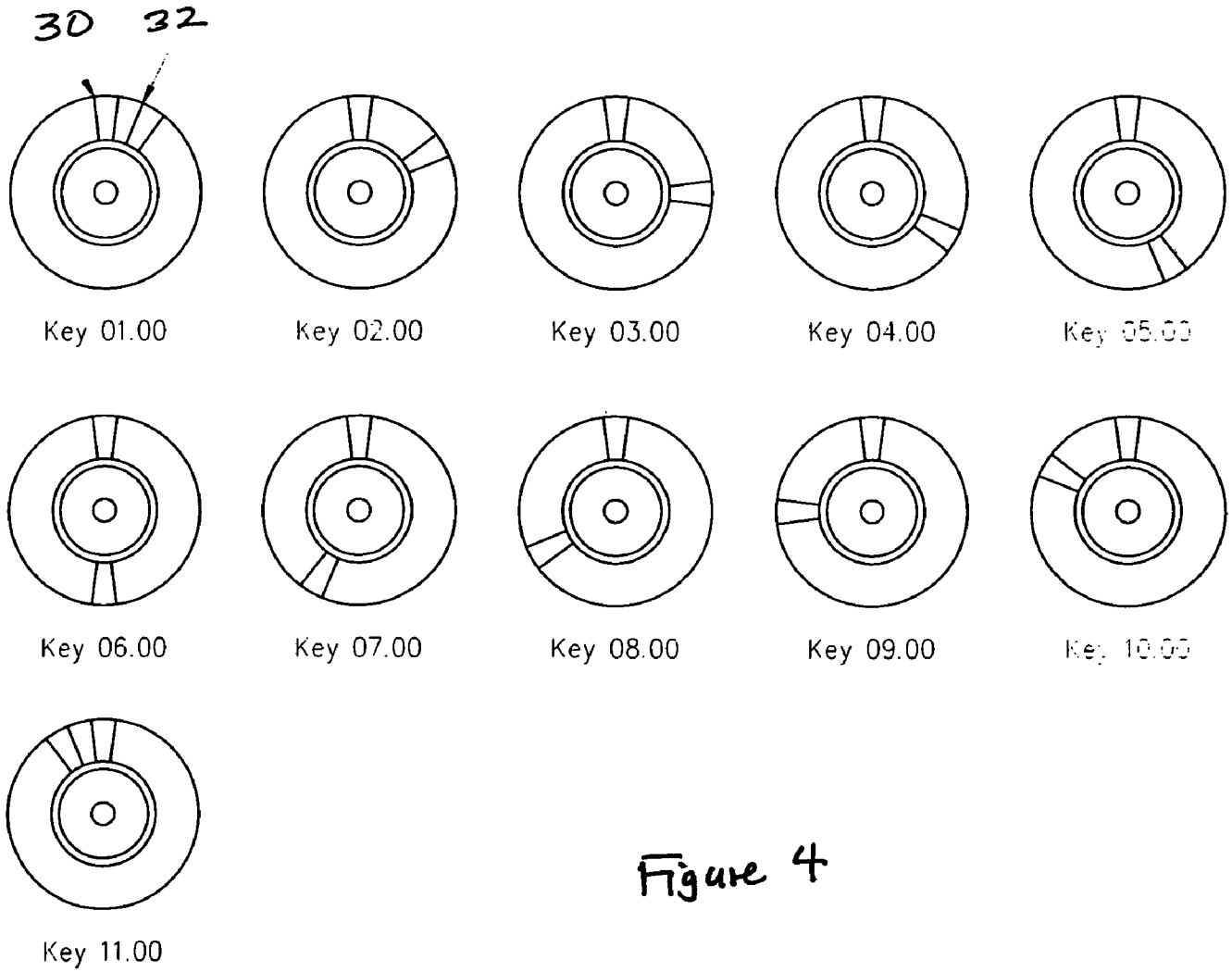
FIG. 4 is a top plan view of different major key configurations which may be used.
Figure 5:
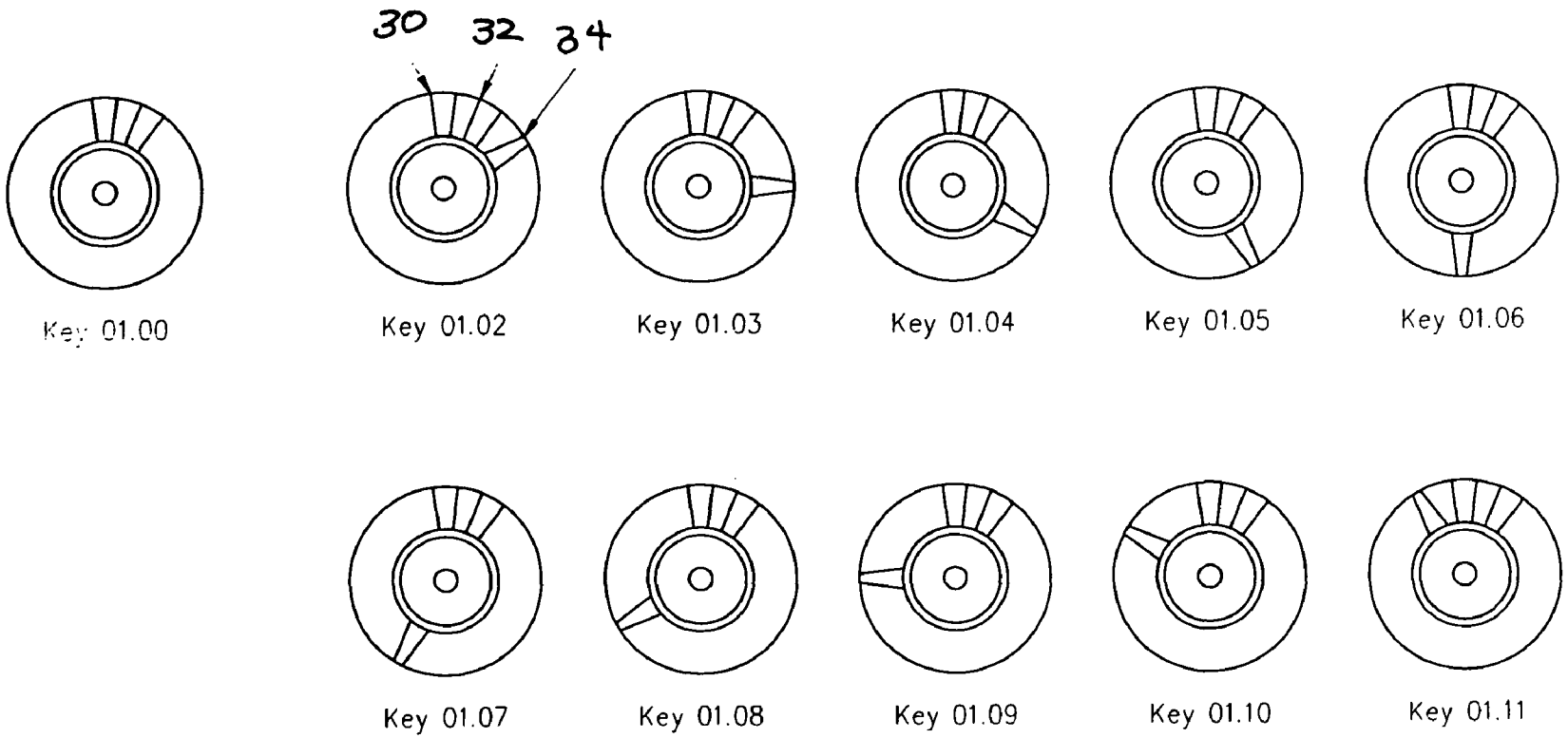
FIG. 5 is a top plan view of different minor key configurations which may be used.

The key arrangement may have many different forms as shown in FIGS. 4 and 5. One way is to have an index key 30 and at least one major key 32. The key arrangement may also have at least one minor key 34. The keys will be described in the context of the nozzle 16, it being understood that the dispenser swivel block 14 will have corresponding key holes or slots to accept the keys of the cartridge nozzle 16 for cartridges that are compatible with the hand washing application and/or other needs or desires of the customer. The index key 30 may have a central location such as that shown in the 12 o'clock position in FIGS. 4 and 5, and is used to orient the nozzle 16 and swivel block 14 so that the other key elements will align properly. FIG. 3 shows the index key 30 being longer than the major key 32 and minor key 34, so the index key 30 will be the first key to be inserted into its corresponding keyhole or slot in the swivel block 14. The remaining major key(s) 32 and minor key(s) 34 may have different locations for each application or customer, making the customer's keying arrangement unique to that customer.

As shown in FIGS. 4 and 5, the key elements may be positioned around the nozzle and swivel block in regular fixed increments such as 30° increments, corresponding in position to the number locations on an analog clock. The key locations can thus be referred to by the "hours" position. One key code format that could be used is XX.xx, where XX is the major key location and xx is the minor key location. If no minor key is used, the key code format may be XX-00. Major key position 01 may be reserved by the manufacturer or distributor of the system, with the remaining ten locations (02-11) available for customer assignment. For example, the key code for the cartridge nozzle/swivel block arrangement in FIG. 3 would be 01.03.

As described above, each customer may be assigned a unique major key. The distributor of the system may charge the customer a fee for tooling the unique key location for that customer. The nozzles of the dispensers for that customer will thus be uniquely keyed for that customer.

The customer may have the option of using one or more of the minor key positions, thereby allowing the customer to differentiate within their product line. For example, a customer having major key 02 may assign 02.01 to dispensers having standard hand soap and 02.03 to dispensers for surgical hand soap. Because the keying of the nozzles and dispensers are different for the two soap products, the standard hand soap would be unable to be installed in a soap dispenser for a hospital surgery room, for example.

It is possible for a customer to have more than one major key and/or more than one minor key. For example, if a customer has one major and two minor keys, the keying will be designated $XX.x_1x_1.x_2x_2$. The dispenser will accept nozzles having $XX.x_1x_1$ or $XX.x_2x_2$ keys.

As shown in FIG. 3, a major key 32 and a minor key 34 may have different shapes to differentiate their status as major or minor. The major key 32 has sides which are along radial lines originating at the center of the nozzle, so that the key becomes wider as one moves radially outward. The minor key 34, has sides in an opposite arrangement so that the key becomes narrower as one moves radially outward.

FIGS. 4 and 5 shows example key arrangements for major key locations and minor key locations. It should be understood that the key elements may have configurations and locations other than those shown in the figures as described above.

Although one preferred embodiment has been described and shown in the drawings, variations will occur to those skilled in the art. The invention is not limited to the preferred embodiment and its scope is defined only by the claims.

I claim:

1. A dispensing system for dispensing cleaning product for hand washing at a faucet, comprising a cartridge having an internal reservoir for containing hand wash cleaning product, and a pump assembly, including a nozzle having a tip through which product exits and configured in one of a plurality of any key shapes, said key shape on said tip comprising at least two different longitudinal keys positioned at different radial locations around a circumference of the nozzle, wherein one longitudinal key extends further along the axial length of the nozzle than the other keys, and starts at said tip to thereby engage the cartridge rotationally with a dispenser before the other keys when the cartridge is axially aligned with a receptacle opening, and wherein the other longitudinal keys start inwardly of said tip; and a dispenser having a block with a receptacle opening adapted to axially receive and engage the nozzle of the cartridge when the receptacle opening is configured in one of a plurality of key shapes corresponding to the key shape of the nozzle, the dispenser having a fluid communication passage for dispensing fluid for hand washing, whereby only cartridges and dispensers which have matched key shapes will engage each other for operative discharge of the hand wash cleaning product.

2. The dispensing system according to claim 1, wherein the cartridge comprises a bottle.

3. The dispensing system according to claim 1, wherein the cartridge comprises a flexible bag.

4. The dispensing system according to claim 1, wherein the cartridge comprises a flexible bag in a box.

5. The dispensing system according to claim 1, wherein the key shape of the cartridge comprises at least one raised fin located on the exterior of the nozzle.

6. The dispensing system according to claim 1, wherein the key shape of the dispenser comprises at least one slot defined in the dispenser.

7. The dispensing system according to claim 1, wherein the key shape of the cartridge comprises at least two raised fins, including at least one index key and one major key different in configuration from the index key.

8. The dispensing system according to claim 1, wherein the key shape of the cartridge comprises at least three raised fins, including at least one index key, one major key and one minor key, each of said keys being different in configuration from each other.

9. The dispensing system according to claim 7, wherein the index key extends further along a surface of the nozzle than any other keys, to engage a corresponding slot in the dispenser before any other keys in the cartridge, to thereby align the cartridge rotationally with the dispenser.

10. A cartridge for use in a dispensing system for fluid product, comprising an internal reservoir for containing fluid product, and a pump assembly, including a nozzle having a tip through which product exits and configured in one of a plurality of key shapes, said key shape on said tip comprising at least two different different longitudinal keys positioned at different radial locations around a circumference of the nozzle wherein one longitudinal key extends further along the axial length of the nozzle than the other keys, and starts at said tip to thereby engage the cartridge rotationally with a dispenser before the other keys, which start inwardly of said tip, when the cartridge is axially aligned with a receptacle opening, said nozzle adapted to be axially received by and engage a receptacle opening in a dispenser when the receptacle opening is configured in one of a plurality of key shapes corresponding to the key shape of the nozzle.

11. The cartridge according to claim 10, wherein the cartridge comprises a bottle.

12. The cartridge according to claim 10, wherein the cartridge comprises a flexible bag.

13. The cartridge according to claim 10, wherein the cartridge comprises a flexible bag in a box.

14. The cartridge according to claim 10, which the key shape of the cartridge comprises at least one raised fin located on the exterior of the nozzle.

15. The cartridge according to claim 10, wherein the key shape of the cartridge comprises at least two raised fins, including at least one index key and one major key different in configuration from the index key.

16. The cartridge according to claim 10, wherein the key shape of the cartridge comprises at least three raised fins, including at least one index key, one major key and one minor key, each of said keys being different in configuration from each other.

17. The cartridge according to claim 16, wherein the index key extends further along a surface of the nozzle than any other keys, to engage a corresponding slot in the dispenser block before any other keys in the cartridge, to thereby align the cartridge rotationally with the dispenser.

18. A cartridge for use in a dispensing system for fluid product, comprising an internal reservoir for containing fluid product, and a pump assembly, including a nozzle having a tip through which product exits and having at least two different longitudinal keys on said tip positioned at different radial locations around a circumference of the nozzle having different configurations wherein one longitudinal key extends further along the axial length of the nozzle than the other keys, and starts at said tip to thereby engage a cartridge rotationally with the dispenser before the other keys, which start inwardly of said tip, when the cartridge is axially aligned with a receptacle opening, said nozzle being adapted to be axially received by and engage a receptacle opening in a dispenser when the receptacle opening is configured to have radial slots corresponding in shape to the longitudinal keys.

19. The cartridge according to claim 18, wherein at least three longitudinal keys are provided having different configurations.

20. A dispensing system for dispensing cleaning product for hand washing at a faucet, comprising a cartridge having an internal reservoir for containing hand wash cleaning product, and a pump assembly, including a nozzle having a tip through which product exits and configured in one of a plurality of any key shapes, said key shape on said tip comprising at least two different different longitudinal keys positioned at different radial locations around a circumference of the nozzle wherein one longitudinal key extends further along the axial length of the nozzle than the other keys, and starts at said tip to thereby engage a cartridge rotationally with the dispenser before the other keys, which start inwardly of said tip, when the cartridge is axially aligned with a receptacle opening; and a dispenser having a block with a receptacle opening adapted to axially receive and engage the nozzle of the cartridge when the receptacle opening is configured in one of a plurality of key shapes corresponding to the key shape of the nozzle, the dispenser having a fluid communication passage for dispensing fluid for hand washing, whereby only cartridges and dispensers which have matched key shapes will engage each other for operative discharge of the hand wash cleaning product.

21. A cartridge for use in a dispensing system for fluid product, comprising an internal reservoir for containing fluid product, and a pump assembly, including a nozzle having a tip through which product exits and configured in one of a plurality of key shapes, said key shape on said tip comprising at least two different different longitudinal keys positioned at different radial locations around a circumference of the nozzle wherein one longitudinal key extends further along the axial length of the nozzle than the other keys, and starts at said tip to thereby engage the cartridge rotationally with a dispenser before the other keys, which start inwardly of said tip, when the cartridge is axially aligned with a receptacle opening, said nozzle adapted to be axially received by and engage a receptacle opening in a dispenser when the receptacle opening is configured in one of a plurality of key shapes corresponding to the key shape of the nozzle.

* * * * *